US006744999B2

(12) United States Patent
Bloemen et al.

(10) Patent No.: US 6,744,999 B2
(45) Date of Patent: Jun. 1, 2004

(54) BLADE SEAL FOR A XEROGRAPHIC MODULE

(75) Inventors: Peter J. M. Bloemen, Cuijk (NL); Pierre W. A. Hendriks, Grubbenvorst (NL); Ton Wijnen, Melderslo (NL)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/348,628

(22) Filed: Jan. 21, 2003

(65) Prior Publication Data

US 2003/0235427 A1 Dec. 25, 2003

Related U.S. Application Data

(60) Provisional application No. 60/391,403, filed on Jun. 24, 2002.

(51) Int. Cl.[7] ..... G03G 21/00
(52) U.S. Cl. ..... 399/102; 399/350
(58) Field of Search ..... 399/102, 103, 399/105, 350, 343, 274, 284; 15/256.5, 256.51

(56) References Cited

U.S. PATENT DOCUMENTS 5,029,316 A * 7/1991 Koiso ..... 399/102
5,389,732 A 2/1995 Sekino ..... 399/103
5,404,216 A * 4/1995 Numagami et al. ..... 399/102
5,475,467 A 12/1995 Watanabe et al. ..... 399/111
5,701,558 A 12/1997 Kojima ..... 399/103
5,774,765 A * 6/1998 Hirota et al. ..... 399/102
5,991,568 A * 11/1999 Ziegelmuller et al. ..... 399/102
2003/0059227 A1 * 3/2003 Korfhage et al. ..... 399/102

FOREIGN PATENT DOCUMENTS

JP 03-012687 * 1/1991
JP 06-027861 * 2/1994
JP 06-308870 * 11/1994

* cited by examiner

*Primary Examiner*—Sophia S. Chen
(74) *Attorney, Agent, or Firm*—R. Hutter

(57) ABSTRACT

In a xerographic printing apparatus, a blade is used to clean the surface of a rotating photoreceptor. At an end of the blade is disposed a flexible sealing member. The sealing member includes a bulk portion, one part of which contacts the surface of the photoreceptor and another part of which is attached to a stationary surface. Extending from the bulk portion is a tab which defines a diagonal edge. A portion of the diagonal edge contacts a surface of the blade.

11 Claims, 2 Drawing Sheets

BLADE SEAL FOR A XEROGRAPHIC MODULE

CLAIM OF PRIORITY FROM PROVISIONAL APPLICATION

Priority is claimed from U.S. Provisional Application No. 60/391,403, filed Jun. 24, 2002.

TECHNICAL FIELD

The present invention relates to a development module for a xerographic printing apparatus, and more specifically to blade seal used in such a module.

BACKGROUND

The basic principles of electrostatographic printing with dry marking material (hereinafter generally referred to as xerography) are well known: an electrostatic latent image is created on a charge-retentive surface, such as a photoreceptor or other charge receptor, and the latent image is developed by exposing it to a supply of toner particles, which are attracted as needed to appropriately-charged areas of the latent image. The toner particles are then transferred in imagewise fashion from the photoreceptor to a print sheet, the print sheet being subsequently heated to permanently fuse the toner particles thereto to form a durable image.

Following the transfer of the image from the photoreceptor to the print sheet, residual toner particles remaining on the photoreceptor are removed by any number of known means, such as including a cleaning blade, brush, and/or vacuum. In a typical embodiment, the removed toner is then accumulated in a hopper, and then the accumulated waste toner is directed, typically by means of an auger, into a waste container.

It is a common design challenge to provide a functional housing around the photoreceptor, which allows operation of the xerographic apparatus while preventing leakage of stray toner particles to unwanted areas within the apparatus.

DESCRIPTION OF THE PRIOR ART

U.S. Pat. Nos. 5,389,732; 5,475,467; and 5,701,558 each disclose a blade and seal arrangement in a xerographic printer.

SUMMARY OF THE INVENTION

According to one aspect of the invention, there is provided an apparatus for use in electrostatographic printing, comprising a roller; a blade positioned against the roller; and an end seal disposed at an end of the blade. The end seal comprises a flexible member defining a main surface and a profile. The profile includes a diagonal edge which is oriented diagonally to a direction of rotation of the roller. The diagonal edge contacts the blade.

DETAILED DESCRIPTION

Figure 1:
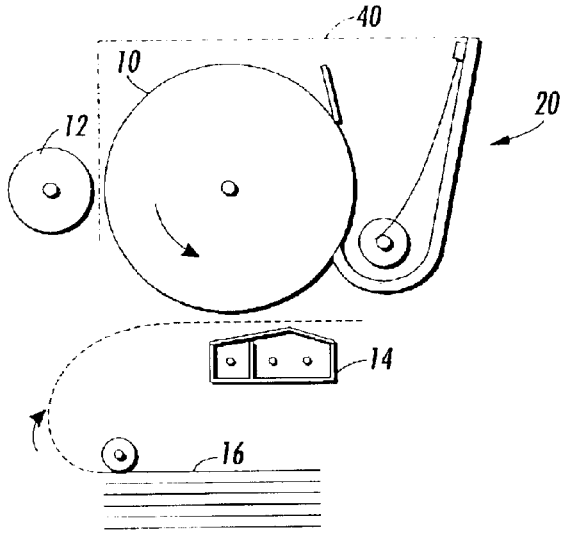
FIG. 1 is a simplified elevational view showing relevant elements of an electrostatographic or xerographic printing apparatus, many of which are disposed within a module.

FIG. 1 is a simplified elevational view showing relevant elements of an electrostatographic or xerographic printing apparatus, many of which are disposed within a module housing generally shown as 40. As is well known, an electrostatic latent image is created, by means not shown, on a surface of a charge receptor or photoreceptor 10. The latent image is developed by applying thereto a supply of toner particles, such as with developer roll 12, which may be of any of various designs such as a magnetic brush roll or donor roll, as is familiar in the art. The toner particles adhere to the appropriately-charged areas of the latent image. The surface of photoreceptor 10 then moves, as shown by the arrow, to a transfer zone created by a transfer-detack assembly generally indicated as 14. Simultaneously, a print sheet on which an desired image is to be printed is drawn from supply stack 16 and conveyed to the transfer zone 14 as well.

At the transfer zone 14, the print sheet is brought into contact or at least proximity with a surface of photoreceptor 10, which at this point is carrying toner particles thereon. A corotron or other charge source at transfer zone 14 causes the toner on photoreceptor 10 to be electrically transferred to the print sheet. The print sheet is then sent to subsequent stations, as is familiar in the art, such as a fuser and finishing devices (not shown).

Figure 2:
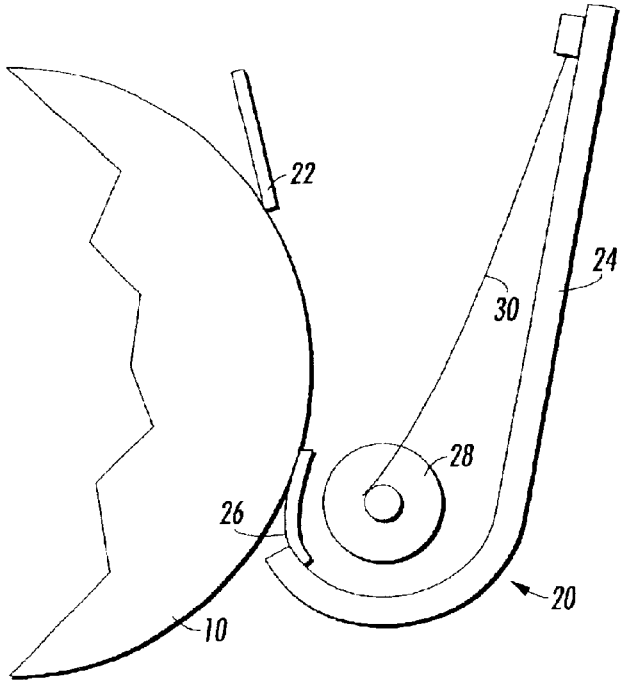
FIG. 2 is an elevational view of a cleaning station formed by part of the module of FIG. 1.

Following transfer of most of the toner particles to the print sheet in the transfer zone, any residual toner particles remaining on the surface of photoreceptor 10 are removed at a cleaning station, which is generally indicated as 20. FIG. 2 is an elevational view of a cleaning station 20. As can be seen in the Figure, a cleaning blade 22 which is urged against the surface of photoreceptor 10 scrapes the residual toner off the surface. The toner which is thus removed falls downward into the housing 24 forming a hopper for accumulating the toner. A flexible flap seal 26, extending the length of the photoreceptor 10, prevents loose toner from escaping the hopper.

At the bottom of the hopper is an auger 28, here shown end-on. The auger extends substantially the length of the photoreceptor 10. The auger 28 is rotated and thus conveys toner particles at the bottom of the hopper to some sort of waste container (not shown). An agitator 30, made of a thin, flexible material, can interact with the auger to clean the flights of the auger.

Figure 3:
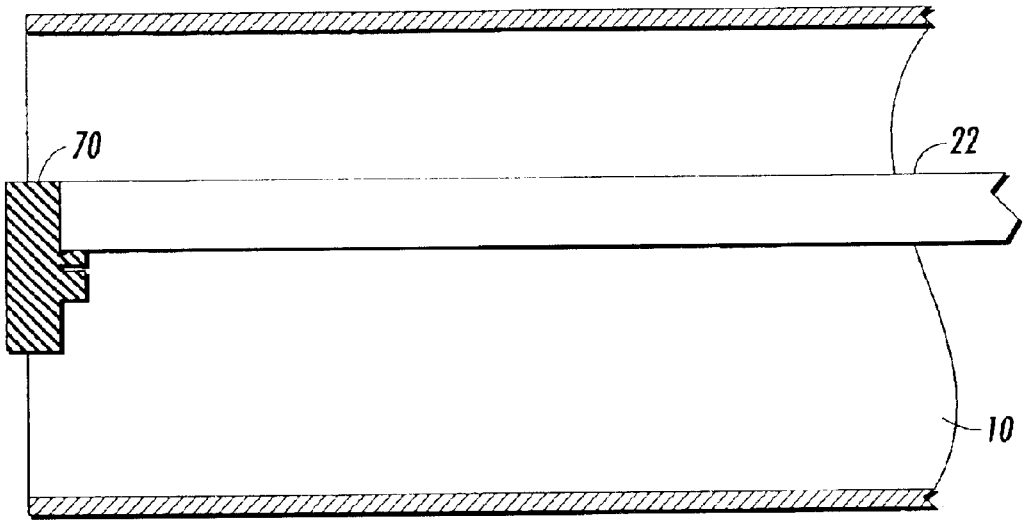
FIG. 3 is an elevational view of the end of a cleaning blade as it is installed against a surface of photoreceptor in a module.
Figure 4:
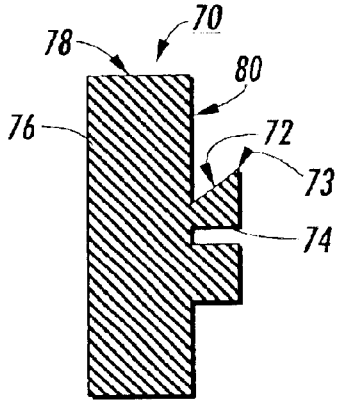
FIG. 4 is a view of a sealing member used in a module, in isolation.

FIG. 3 is an elevational view of the end of cleaning blade 22 as it is installed against a surface of photoreceptor 10, while FIG. 4 is a view of a sealing member 70 used therein, in isolation. Turning first to sealing member 70 itself, the sealing member comprises a resilient material forming the bulk thereof, with a low-friction surface defined on one main side thereof: a portion of this main side is intended to abut, and slide against, a rotating surface of photoreceptor 10, as shown in FIG. 4. The overall profile of the sealing member 70 includes a number of "straight" sides which are intended to be largely perpendicular to the direction of rotation of the photoreceptor 10, and also to the end edge of the cleaning blade 22. However, the profile also defines a diagonal edge 72, of which a tip portion 73 which is intended to contact the long "cleaning edge" of cleaning blade 22.

Comparing FIGS. 3 and 4, it can be seen that, when the cleaning blade is installed therewith in the module, the tip portion 73 formed by diagonal edge 72 is partially flattened, and put in contact with blade 22. An indentation 74 in the profile, opposite the diagonal edge relative to the blade 22, functions as a 'tell tale' during installation, ensuring minimal force is exerted to the working edge of the cleaner blade 22.

If, during installation, the tip 73 of the diagonal portion is barely touching the blade 22, rotation of the photoreceptor 10, in combination with the (low) seal friction on the main surface of the sealing member 70, will move the portion of the seal between edge 72 and indentation 74 in the direction of the cleaner blade, allowing the tip 73 to get in contact with and seal the blade area, thus assuring the sealing function.

In the illustrated embodiment, the portion of the sealing member 70 which defines the diagonal edge 72 and indentation 74 extends as a tab from a bulk portion of the sealing member which is indicated as 76. When the sealing member 70 is installed in an apparatus, part of the main surface of the bulk portion 70 is in contact with, and slides against, an edge of the rotating photoreceptor 10, while the rest of the bulk portion 76 is attached to a stationary surface within the apparatus (not shown). Also, a lead edge of the bulk portion, such as indicated as 78, extends upstream of the diagonal edge 72 along the direction of movement of photoreceptor 10. The edge of the profile between the lead edge 78 and the diagonal edge 72 forms a side edge 80 which, as can be seen in FIG. 3, contacts the side edge of the blade 22 when the sealing member 70 and blade 22 are installed in an apparatus.

What is claimed is:

1. An apparatus for use in Xerographic printing, comprising:

a roller;

a blade positioned against the roller;

a sealing member disposed at an end of the blade, the sealing member defining a main surface and a profile, the profile including a diagonal edge which is oriented diagonally to a direction of rotation of the roller, the diagonal edge contacting the blade, the profile further including an indentation defined adjacent the diagonal edge opposite the blade.

2. The apparatus of claim 1, at least a portion of the diagonal edge contacting an edge of the blade when the sealing member and blade are installed in the apparatus.

3. The apparatus of claim 1, the sealing member including a bulk portion, the diagonal edge being defined on a tab which extends from the bulk portion.

4. The apparatus of claim 3, a first portion of the bulk portion being in contact with a surface of the roller, and a second portion of the bulk portion being attached to a stationary surface of the apparatus.

5. The apparatus of claim 3, the bulk portion defining a lead edge extending upstream of the diagonal edge along a direction of movement of the roller.

6. The apparatus of claim 3, the bulk portion defining a side edge which contacts a side edge of the blade.

7. The apparatus of claim 1, the main surface comprising a low-friction surface.

8. The apparatus of claim 1, at least a portion of the main surface abutting a surface of the roller.

9. The apparatus of claim 1, the blade positioned to act as a cleaning blade for the roller.

10. The apparatus of claim 1, the roller being a charge receptor.

11. The apparatus of claim 1, the apparatus being a module separable from a printing apparatus.

* * * * *